US006358086B1

(12) United States Patent
Gallagher et al.

(10) Patent No.: US 6,358,086 B1
(45) Date of Patent: Mar. 19, 2002

(54) CONNECTOR ASSEMBLY

(75) Inventors: Rodney Evans Gallagher, Middletown; Robert Carl Briggs, Newport, both of PA (US)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/745,789

(22) Filed: Dec. 22, 2000

(51) Int. Cl.[7] ..... H01R 13/60
(52) U.S. Cl. ..... 439/538; 439/539
(58) Field of Search ..... 439/538, 539, 439/544, 545, 562, 563, 569, 570, 571, 572, 247, 248, 552

(56) References Cited

U.S. PATENT DOCUMENTS 4,909,748 A * 3/1990 Kozono et al. ..... 439/247
4,921,435 A * 5/1990 Kane et al. ..... 439/248
4,978,313 A * 12/1990 Kameyama et al. ..... 439/248
5,487,680 A * 1/1996 Yamanashi ..... 439/552
5,660,564 A * 8/1997 Yamanashi et al. ..... 439/557
5,876,228 A * 3/1999 Hayashi ..... 439/248
5,980,291 A * 11/1999 Ono ..... 439/247
6,033,247 A * 3/2000 Gregory, II ..... 439/248
6,139,346 A * 10/2000 Cecil, Jr. et al. ..... 439/247

* cited by examiner

*Primary Examiner*—Gary Paumen
*Assistant Examiner*—Ross Gushi

(57) ABSTRACT

A universal connector assembly for mounting one or more universal connectors within a pair of facing, spaced apart connector slots of a connector outlet. The connector assembly is made up of a mounting yoke and the one or more connectors. The mounting yoke contains a pair of flanges, connected by a crossbar, configured to interfit within the connector slots of the connector outlet. In addition, the mounting yoke contains bracing members and latching elements interengageable with latching elements of the connectors for fixed positioning the connectors in relation to the mounting yoke and locking the connectors in position against the bracing members. The connectors are positioned within the mounting yoke to form the connector assembly. The connector assembly is then positioned within the connector outlet to provide a secure connection location.

19 Claims, 3 Drawing Sheets

CONNECTOR ASSEMBLY

FIELD OF THE INVENTION

The present invention relates to connectors and, more particularly, to a connector assembly for mounting one or more connectors within a connector outlet.

BACKGROUND OF THE INVENTION

A connector outlet is commonly used at a central location to bring together many external cables at a common junction. Generally, connectors are mounted within the connector outlet to provide a secure connection location for the external cables. The external cables are attached to the connectors utilizing connectors on the external cables which are interengageable with the connectors mounted within the connector outlet.

FIG. 1 depicts a prior art connector outlet 1 capable of providing a common junction for bringing external cables together. The connector outlet 1 is made up of a connector outlet base 1A and a connector outlet cover 1B. The connector outlet base 1A is used to secure connectors within the connector outlet 1 and the connector outlet cover 1B provides protection for cables and cable connections within the connector outlet 1. After a connector is positioned within the connector outlet base 1A, the connector outlet cover 1B is joined with the connector outlet cover 1B. The connector outlet base 1A may be mounted to a surface using fasteners 3. An exemplary connector outlet is a HIDEAWAY Wall Outlet available through ANP® Incorporated, Part No. 406188-1.

The connector outlet base 1A and connector outlet cover 1B contain connector openings 4A and 4B, respectively, for accommodating connectors. In addition to connector openings 4A and 4B, the connector outlet base 1A and cover 1B contains other openings 7A and 7B for accommodating additional connectors. The connector openings 4A of the connector outlet base 1A contain as a pair of facing, spaced apart connector slots 2 which define each connector opening 4A. Each pair of connector slots 2 enable a connector designed for use with the connector slots 2 to be positioned securely within the connector outlet base 1A. The configuration of the connector slots 2 within the connector outlet base 1A allows the connectors to be positioned within the connector outlet 1 such that the connectors are parallel to the surface on which the connector outlet base 1A is mounted. This arrangement is referred to as a parallel dress configuration.

There are many different prior art connectors currently available for establishing connections between cables. These prior art connectors contain connection ports having many different connection types including, but not limited to, MT, RJ, SC, and ST connection types. FIG. 2 depicts a prior art MT-RJ connector 10. The MT-RJ connector 10 features an MT type connection port 12 on one end and a splice connection port 14 on the other. It would be advantageous to be able to use an existing connector, such as the MT-RJ connector 10, within the connector outlet 1. In order for a connector to be used within the connector outlet 1, however, the connector must be dimensioned such that it fits within the connector opening 4A and engages the facing, spaced apart connector slots 2 of the connector outlet base IA.

An existing approach for using a prior art connector having a desired connection type within the connector outlet base 1A is to specially produce a new connector based on the prior art connector. The new connector is designed such that it may be secured within the pair of facing, spaced apart connector slots 2 while retaining the connection type of the prior art connector. FIG. 3A and 3B depict prior art connectors 8,9 produced through this approach for use within the connector outlet 1. Connector 8 is an SC Duplex Receptacle available through AMP® Incorporated, Part No. 502772, and connector 9 is an ST Duplex Receptacle available through AMP® Incorporated, Part No. 503113.

Each of the prior art connectors 8,9 contain flanges 6 for securing the connectors 8,9 within the pair of facing, spaced apart connector slots 2 of the connector outlet base IA. The current practice is to design the connectors 8,9 with two connection ports 5 (i.e., a duplex connector) which are inseparable. In addition, the flanges 6 of the prior art connectors 8,9 are inseparable. If a user does not need both ports 5 of a connector 8,9, one of the ports is capped. Also, since the ports 5 of an individual connector 8,9 are inseparable and the flanges 6 are inseparable from the ports 5, connectors 8,9 may not be used for other applications III where size restriction will permit the use of only a single connection port 5 or connection ports without flanges 6.

Using the existing approach to develop a new connector based on a prior art connector, such as the Nff-RJ connector 10 of FIG. 2, results in an inflexible duplex connector having flanges which would render the connector 10 useless for other applications. 1F In addition, since the ports of the connector would be inseparable, the inflexible connector could not be reconfigured (i.e., changed between a simplex connector and a duplex connector).

Waste results from the inflexibility of connectors produced using the existing approach. The inflexibility prevents the use of existing prior art connectors in the connector outlet 1 and prevents connectors specially designed for use in the connector outlet 1 from being used for other applications. In addition, the inflexibility prevents the connectors from being reconfigured as either simplex or duplex connectors. Since the connectors are not interchangeable nor reconfigurable, at least two different styles of connectors will have to be produced, thereby increasing inventory, storage, and tracking costs. Also, if only duplex connectors are produced, materials are wasted on the extra port 5 and a cap for that port when only a simplex connector is required.

Accordingly, a need has arisen for adaptive means allowing one or more existing connectors, such as the MT-RJ connector of FIG. 2, to be securely positioned within connector slots of a connection outlet while allowing the connector to be used for existing applications.

SUMMARY OF THE INVENTION

The present invention comprises a universal connector assembly for mounting one or more universal connectors within a connector outlet having a pair of facing, spaced apart connector slots. The connector assembly is made up of a mounting yoke and the one or more universal connectors. The connectors are positioned within the mounting yoke to form the connector assembly. The connector assembly is then positioned within the connector outlet to provide a secure connection location on the connector outlet.

The mounting yoke of the present invention contains a pair of flanges, connected by a crossbar, configured to interfit within the connector slots of the connector outlet. In addition, the mounting yoke contains bracing members and latching elements for fixed positioning the connectors in relation to the mounting yoke and locking the connectors in position against the bracing members. Each of the connectors contains a groove configured to receive the crossbar of the mounting yoke and latching elements which are interengageable with the latching elements of the mounting yoke.

The mounting yoke of the present invention allows existing connectors to be positioned within the connector outlet with modifications to the connector which do not render the connection useless for other applications. In addition, the mounting yoke can be configured to accommodate one or more connectors for positioning within the same connector slot of the connector outlet. Therefore, to change from a simplex connector to a duplex connector, the mounting yoke is changed while using the same connectors. This arrangement increases flexibility and reduces waste.

It follows from the foregoing that an objective of the present invention is to enable a connector to be securely and easily positioned within a pair of facing, spaced apart connector slots of a connector outlet.

Another objective of the present invention is to enable a connector to be used interchangeably within a simplex connector assembly or a duplex connector assembly.

Yet another objective of the present invention is to allow existing types of connector to be used within a pair of facing, spaced apart connector slots of a connector outlet without modifications which would render the connector unuseable for other applications.

These objectives, among others, will be made apparent to those skilled in the art by way of the following description.

DETAILED DESCRIPTION OF THE INVENTION

Figure 1:
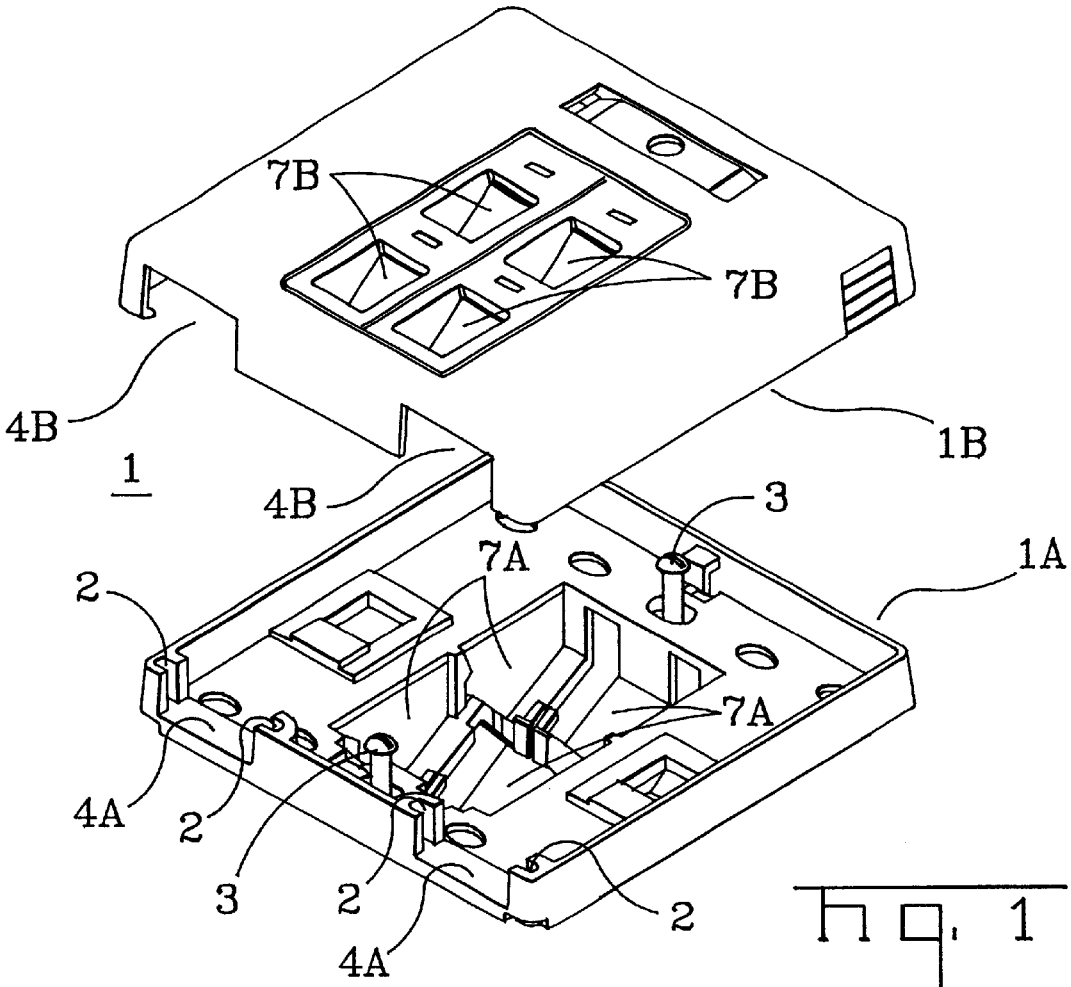
Fig. 1 (Prior art)
FIG. 1 is a perspective view of a prior art connector outlet having a pair of facing, spaced apart connector slots for receiving a connector.

The present invention relates to a universal connector assembly for positioning one or more universal connectors within a connector outlet such as the prior art connector outlet 1 of FIG. 1. The connector outlet base 1A of the prior art connector outlet 1 contains connector openings 4A. The sides of the openings 4A are defined by a pair of facing, spaced apart connector slots 2 for receiving the universal connector assembly of the present invention.

Figure 4A:
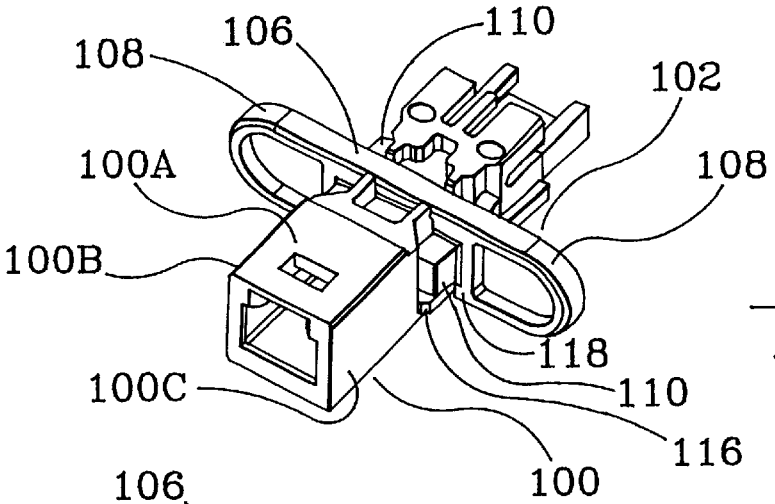
FIG. 4A is a perspective view of the invention comprising a single connector within a single connector mounting yoke made in accordance with the present invention.
Figure 4B:
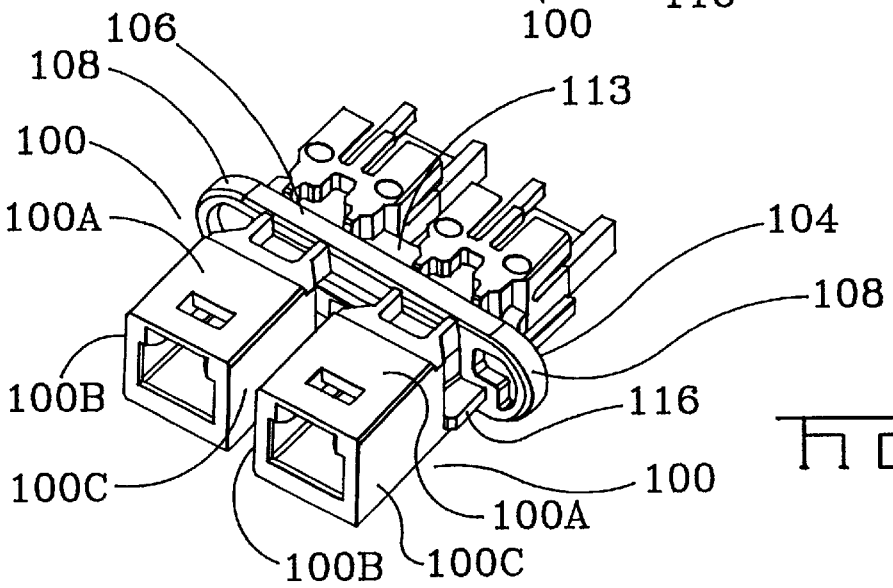
FIG. 4B is a perspective view of the invention comprising two connectors within a double connector mounting yoke made in accordance with the present invention.

FIG. 4A depicts a preferred embodiment for mounting a single connector 100 within the connector slots 2 in accordance with the present invention, and FIG. 4B depicts a preferred embodiment for mounting two connectors 100 within the connector slots 2 in accordance with the present invention. In the assembly depicted in FIG. 4A, the connector 100 is positioned within a separate, single connector mounting yoke 102 to form a simplex connector assembly for positioning within the connector outlet base 1A. In the assembly depicted in FIG. 4B, two of the connectors 100 are positioned within a double connector mounting yoke 104 to form a duplex connector assembly for mounting within the connector outlet base 1A. In the preferred embodiments, upon positioning the simplex connector assembly or the duplex connector assembly within the connector outlet base 1A, the connectors 100 within the assemblies will be oriented such that they are parallel to the surface on which the connector outlet base 1A is mounted. In this configuration, the simplex and duplex connector assemblies are referred to as parallel dress assemblies.

Figure 5:
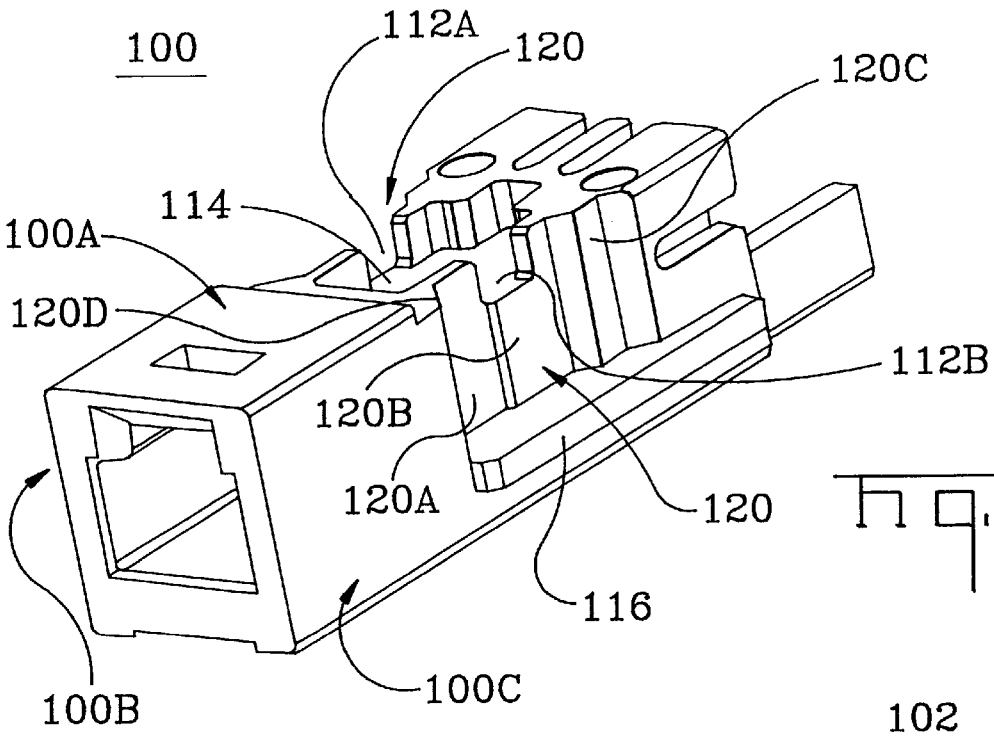
FIG. 5 is a perspective view of a connector for use in a single connector mounting yoke or a double connector mounting yoke in accordance with the present invention.

FIG. 5 is an enlarged view of a preferred connector 100 for use in accordance with the present invention. The connector 100 contains a top surface 100A, a left side surface 100B (represented by the left hand front edge but identical to the right side surface, and a right side surface 100C. The left side surface 100B and the right side surface 100C extend away from the top surface 100A. The top surface 100A of the connector 100 contains a groove 114 which, in the preferred embodiment, is defined by a pair of spaced notches 112A and 112B in the top surface 100A of the connector 100. The left side surface 100B and the right side surface 100C of the connector 100 each contain identical latching projections 116, one of which is shown in FIG. 5. In addition, the left side surface 100B and the right side surface 100C each contain a contoured surface area 120. As depicted in FIG. 5, the contoured surface area 120 on the right side surface 100C comprises a first tier 120A, a second tier 120B, a third tier 120C, and an angled region 120D. The contoured surface area 120 on the left side surface 100B contains tiers and an angled region similar to the tiers 102A, 120B, and 120C and the angled region 120D of the contoured surface area 120 on the right side surface 100C.

Figure 2:
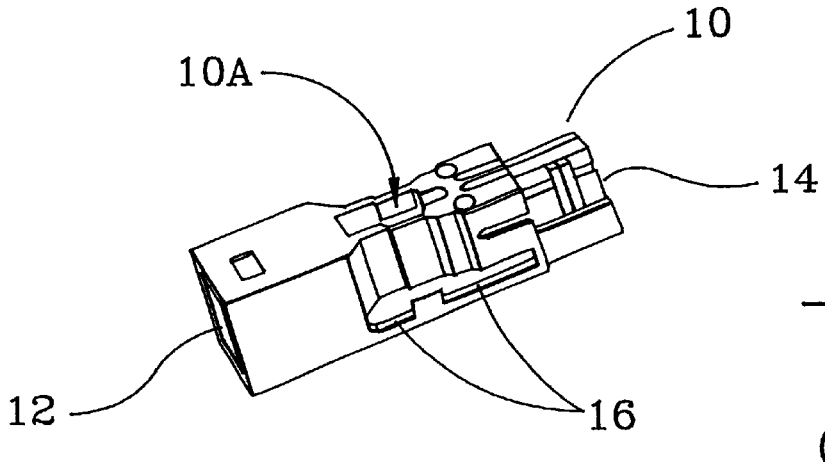
Fig. 2 (Prior art)
FIG. 2 is a perspective view of a prior art connector.
Figure 3A:
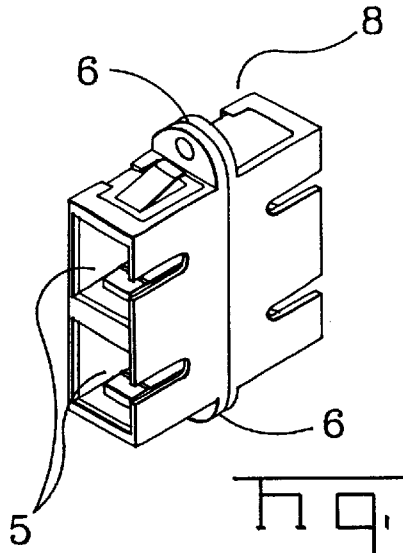
Fig. 3A (Prior art)
FIG. 3A is a perspective view of a prior art duplex connector for use with the connector outlet of FIG. 1.
Figure 3B:
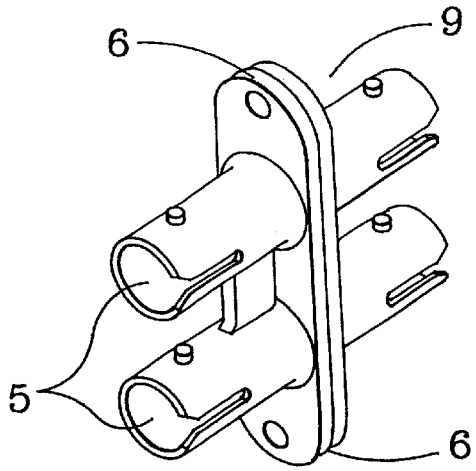
Fig. 3B (Prior art)
FIG. 3B is a perspective view of another prior art duplex connector for use with the connector outlet of FIG. 1.

The preferred connector 100 is a modified version of the prior art MT-RJ connector 10 depicted in FIG. 2. The modifications to the prior art connector 10 include modifying the stabilizing guide 16 to be a single continuous piece, as illustrated by the latching projection 116 of FIG. 5, and creating a groove in the top surface 10A, as illustrated by the left notch 112A and the right notch 112B in the connector 100 of FIG. 5. Other suitable connectors for use in accordance with the present invention will be readily apparent to those skilled in the art. The invention may be used with some presently available connectors of generally similar design without modification, but some modification may be desirable, such as the modifications of the preferred connector 100, to optimize them for use with the present invention. In the preferred embodiments, the connector modifications do not render the connector unsuitable for existing applications.

Figure 6A:
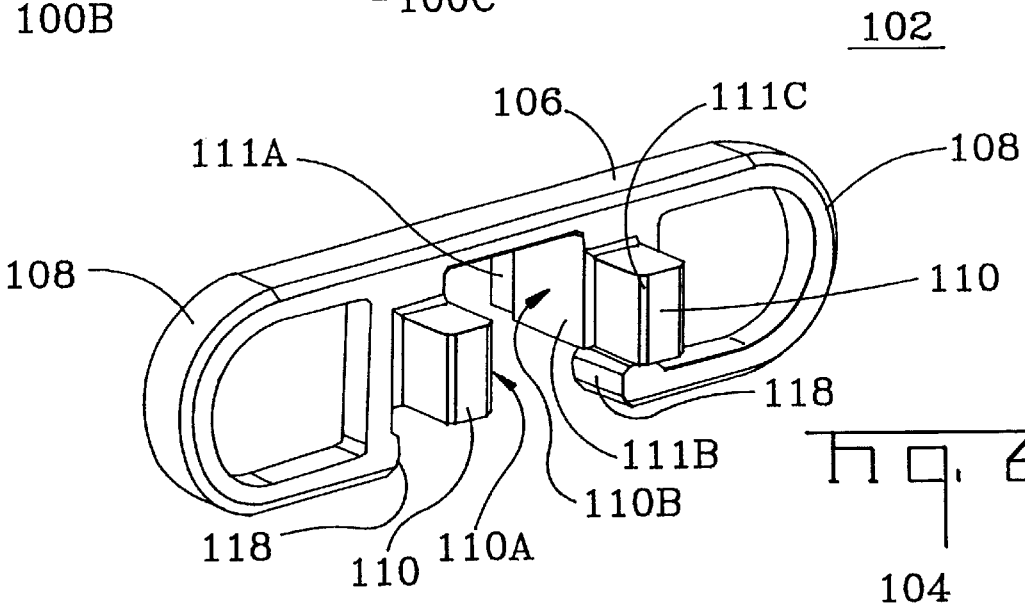
FIG. 6A is a perspective view of a single connector mounting yoke for use in accordance with the present invention.

As shown in FIG. 4A and FIG. 6A the single connector mounting yoke 102 is made up of a crossbar 106 and a pair of flanges 108. In addition, the single connector mounting yoke 102 contains a pair of bracing members 110 and a pair of resiliently yieldable detent latches 118. The pair of flanges 108 are dimensioned to interfit with the pair of facing, spaced apart connector slots 2 securely when the single connector mounting yoke 102 is positioned within the connector opening 4A of the connector outlet base 1A.

As depicted in FIG. 6A, the bracing member 110 on the right side of the single connector mounting yoke 102 has a right side bracing surface 110B comprising a first tier 111A, a second tier 111B, and an angled portion 111C. In addition, the bracing member 110 on the left side of the single connector mounting yoke 102 has a left side bracing surface 110A comprising two tiers and an angled portion similar to the two tiers 111A and 111B and the angled portion 111C of the right side bracing surface 110B.

In order to mount the connector 100 within the connector outlet 1 of FIG. 1, the connector 100 is positioned within the single connector mounting yoke 102 to form the simplex connector assembly of FIG. 4A. The simplex connector assembly may then be positioned within the connector opening 4A of the connector outlet base 1A where the pair of flanges 108 will engage the pair of facing, spaced apart connector slots 2 securely. This enables the connector outlet 1 to provide a secure connection point for external cables having connectors which are interengageable with the connector 100. The connector outlet cover 1B may then be positioned over the connector outlet base 1A.

The connector 100 and the single connector mounting yoke 102 are configured such that the crossbar 106 interfits within the groove 114 (FIG. 5) upon inserting the connector 100 within the single connector mounting yoke 102. Interfitting the crossbar 106 within the groove 114 results in increased stability between the connector 100 and the single connector mounting yoke 102. When the flanges 108 of the single connector mounting yoke 102 are positioned within the facing, spaced apart connector slots 2, the groove 114 is oriented such that it is extending towards the facing, spaced apart connector slots 2.

The left side bracing surface 110A and the right side bracing surface 110B engage the left side surface 100B and the right side surface 100C, respectively, to fixedly position the connector 100 relative to the single connector mounting yoke 102 upon inserting the connector 100 within the single connector mounting yoke 102. In a preferred embodiment, the left side bracing surface 110A and the right side bracing surface 10B conform to the shape of the corresponding side surfaces 100B and 100C which they engage. For example, the first tier 111A, the second tier 111B, and the angled portion 111C of the right side bracing surface 110B are dimensioned to engage portions of the third tier 120C, the second tier 120B, and the angled region 120D of the right side surface 100C of the connector 100, respectively. Likewise, the tiers and angled portion of the left side bracing surface 110A are dimensioned to engage portions of the tiers and angled region of the left side surface 100B of the connector 100.

The yieldable detent latches 118 of the single connector mounting yoke 102 are interengageable with the latching projections 116 of the connector 100. Although other latching means may be employed, in a preferred embodiment, the yieldable detent latches 118 are made of a pliable material which allows the connector 100 to be inserted into and removed from the single connector mounting yoke 102 with a minimal amount of force. Upon inserting the connector 100 within the single connector mounting yoke 102, the yieldable detent latches 118 fit beneath the lower edges of the latching projections 116, thereby locking the connector 100 in position, with the bracing members 110A and 110B of the mounting yoke 102 pressing against the contoured surfaces 120 of a corresponding side surface 100B or 100C of the connector 100 to secure the connector 100 within the single connector mounting yoke 102.

Figure 6B:
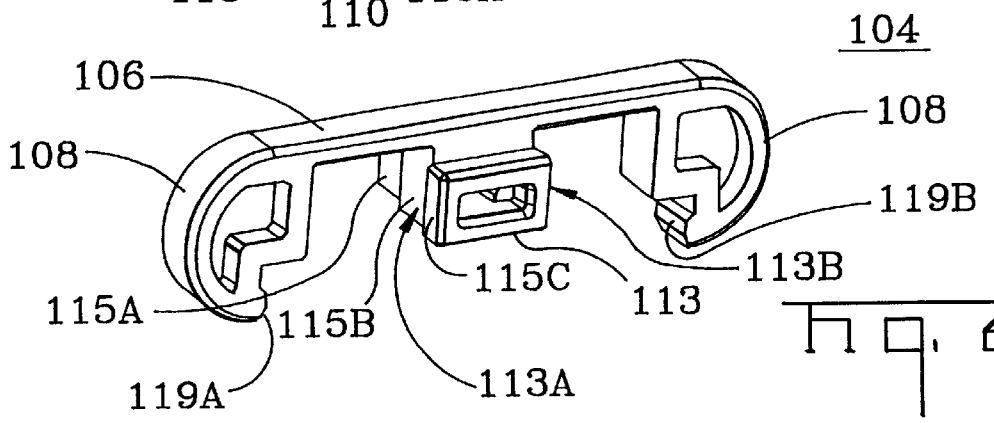
FIG. 6B is a perspective view of a double connector mounting yoke for use in accordance with the present invention.

As shown in FIG. 4B and FIG. 6B the double connector mounting yoke 104 is made up of a crossbar 106 and a pair of flanges 108. In addition, the double connector mounting yoke 104 contains a left resiliently yieldable detent latch 119A, a right resiliently yieldable detent latch 119B, and a bracing member 113 having a left side bracing surface 113A and a right side bracing surface 113B. The pair of flanges 108 are dimensioned to interfit with the pair of facing, spaced apart connector slots 2 securely when the double connector mounting yoke 104 is positioned within the connector opening 4A of the connector outlet base 1A.

As depicted in FIG. 6B, the left side bracing surface 113A of the double connector mounting yoke 104 comprises a first tier 115A, a second tier 115B, and a third tier 115C. In addition, the right side bracing surface 113B comprises three tiers like the three tiers 115A, 115B, and 115C of the left side bracing surface 113A.

In order to mount each of the connectors 100 within the connector outlet 1 of FIG. 1, each of the connectors 100 are positioned within the double connector mounting yoke 104 to form the duplex connector assembly of FIG. 4B. The duplex connector assembly may then be positioned within the connector opening 4A of the connector outlet base 1A where the pair of flanges 108 will engage the pair of facing, spaced apart connector slots 2 securely. This enables the connector outlet 1 to provide a secure connection point for external cables having connectors which are interengageable with the connectors 100. The connector outlet cover 1B may then be positioned over the connector outlet base 1A.

The two connectors 100 and the double connector mounting yoke 104 are configured such that the crossbar 106 interfits within the grooves 114 (FIG. 5) of each of the two connectors 100 upon inserting each of the two connectors 100 within the double connector mounting yoke 104. Interfitting the crossbar 106 within the grooves 114 results in increased stability between the each of the connectors 100 and the double connector mounting yoke 104. When the flanges 108 of the double connector mounting yoke 104 are positioned within the facing, spaced apart connector slots 2, the grooves 114 of both of the connectors 100 are oriented such that they are extending towards the facing, spaced apart connector slots 2.

The left side bracing surface 113A engages the right side surface 100C of one of the connectors 100, and the right side bracing surface 113B engages the left side surface 100B of the other connector 100, to fixedly position each of the connectors 100 relative to the double connector mounting yoke 104 upon inserting each of the connectors 100 within the double connector mounting yoke 104. In a preferred embodiment, the left side bracing surface 113A conforms to the shape of the right side surface 100C of its corresponding connector 100 and the right side bracing surface 113B conforms to the shape of the left side surface 100B of its corresponding connector 100. For example, the first tier 115A, the second tier 115B, and the third tier 120C of the left side bracing surface 113A are dimensioned to engage portions of the third tier 120C, the second tier 120B, and first tier 120A of the right side surface 100C of its corresponding connector 100, respectively. Likewise, the tiers of the right side bracing 7 surface 113B are dimensioned to engage portions of the tiers of the left side surface 100B of its corresponding connector 100.

Latching of the double connector mounting yoke 104 of FIG. 6B to connectors 100 is preferably accomplished in a manner similar to the latching of the single connector mounting yoke 102. The right yieldable detent latch 119B of the double connector mounting yoke 104 is interengageable with the latching projection 116 of the right side surface 100C of one of the connectors 100, and the left yieldable detent latch 119A of the double connector mounting yoke 104 is interengageable with a latching projection of the left side surface 100B of the other connector 100. The latching projection of the left side surface 100B is identical to the latching projection 116 of the right side surface 100C. Upon inserting each of the connectors 100 within the double connector mounting yoke 104, the left and right yieldable detent latches 119A and 119B engage the latching projection of the corresponding connector 100, thereby locking each of the connectors 100 in position against the bracing member 113 to secure each of the connectors 100 within the double connector mounting yoke 104.

Having thus described particular preferred embodiments of the invention, various alterations, modifications, and improvements will readily occur to those skilled in the art. For example, mounting yokes which will accommodate more than two connectors are within the scope of the present invention. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A connector assembly for mounting a connector within a pair of facing, spaced apart connector slots of a connector outlet, said connector assembly comprising:

a first connector having a first surface having a groove extending towards the spaced apart connector slots and side surfaces extending away from said first surface; and a mounting yoke for mounting said first connector within the connector slots, said mounting yoke comprising a crossbar interfitting with the groove on said first surface and a pair of flanges interfitting within the connector slots, said mounting yoke further comprising a first bracing member engageable with one of said side surfaces for fixed positioning of said first connector relative to said mounting yoke; and first interengageable latching elements on the other of said side surfaces and on one of said flanges spaced from said first bracing member, said first interengageable latching elements locking said first connector in position against said first bracing member.

2. The connector assembly of claim 1, wherein said first interengageable latching elements comprise a latching projection on the other of said side surfaces and a resiliently yieldable detent latch on the one of said flanges.

3. The connector assembly of claim 1, wherein said first bracing member conforms to the shape of the one of said side surfaces engaged by said first bracing member.

4. The connector assembly of claim 1, wherein said mounting yoke further comprises a second bracing member engageable with the other of said side surfaces for fixed positioning of said first connector relative to said mounting yoke; and wherein said connector assembly farther comprises second interengageable latching elements on the one of said side surfaces and on the other of said flanges spaced from said second bracing member, said second interengageable latching elements locking said first connector in position against said second bracing member.

5. The connector assembly of claim 4, wherein said first and second interengageable latching elements comprise a latching projection on each of said side surfaces and a resiliently yieldable detent latch on each of said flanges, each of said detent latches being interengageable with one of said latching projections.

6. The connector assembly of claim 4, wherein said first bracing member conforms to the shape of the one of said side surfaces and said second bracing member conforms to the shape of the other of said side surfaces.

7. The connector assembly of claim 4, wherein the combination of said mounting yoke and said first connector form a parallel dress assembly.

8. The connector assembly of claim 1, further comprising:

a second connector having a first surface having a groove extending towards the spaced connector slots and side surfaces extending away from said first surface, wherein said mounting yoke further mounting said second connector within the connector slots, said crossbar of said mounting yoke interfitting with the groove of said first surface of the second connector, said first bracing member further engageable with one of said side surfaces of said second connector for fixed positioning of said second connector relative to said mounting yoke; and second interengageable latching elements on the other of said side surfaces of said second connector and on the other of said flanges spaced from said first bracing member, said second interengageable latching elements locking said second connector in position against said first bracing member.

9. The connector assembly of claim 8, wherein said first interengageable latching elements comprise a latching projection on the one of said side surfaces and a resiliently yieldable detent latch on the one of said flanges, and said second interengageable latching elements comprise a latching projection on the one of said side surfaces and a resiliently yieldable detent latch connected to the other of said flanges.

10. The connector assembly of claim 8, wherein one side of said first bracing member conforms to the shape of the one of said side surfaces of said first connector and an opposing side of said first bracing member conforms to the shape of the one of said side surface of said second connector.

11. The connector assembly of claim 8, wherein the combination of said mounting yoke, said first connector, and said second connector form a parallel dress assembly.

12. A mounting yoke for mounting a connector within a pair of facing spaced apart connector slots of a connector outlet, the connector having a first surface having a groove extending towards the spaced connector slots and side surfaces extending away from the first surface, each of the side surfaces having a latching element, said mounting yoke comprising:

a pair of flanges interfitting within the connector slots of the connector outlet, a first of said flanges having a first bracing member and a first latching element, and a second of said flanges having a second bracing member and a second latching element, said first bracing member engageable with a first of said side surfaces and said second bracing member engageable with a second of said side surface for fixed positioning of said connector relative to said mounting yoke, and said first latching elements interengageable with the latching element of the second of said side surfaces and said second latching elements interengageable with the latching element of the first of said side surfaces for locking said connector in position against said first and second bracing members; and a crossbar connecting said pair of flanges, said crossbar interfitting with the groove on the first surface of the connector.

13. The mounting yoke of claim 12, wherein each of the latching elements of the connector comprise a latching projection and each of said latching elements of said mounting yoke comprise a resiliently yieldable detent latch.

14. The connector assembly of claim 12, wherein said first bracing member conforms to the shape of the first of said side surfaces and the second bracing member conforms to the shape of the second of said side surfaces.

15. The connector assembly of claim 12, wherein said mounting yoke enables the connector to be positioned within a parallel dress socket of the connector outlet.

16. A mounting yoke for mounting a pair of connectors within a pair of facing, spaced apart connector slots of a connector outlet, each of the pair of connectors having a first surface having a groove extending towards the spaced connector slots and side surfaces extending away from the first surface, one of the side surfaces of each of the pair of connectors having a latching element, said mounting yoke comprising:

a crossbar interfitting with the grooves on the first surfaces of each of the pair of connectors;

a bracing member connected to said crossbar between each of the pair of connectors said bracing member engaging the other of the side surfaces of each of the pair of connectors for fixed positioning of the pair of connectors relative to said mounting yoke; and a pair of flanges interfitting within the connector slots of the connector outlet, said pair of flanges connected by said crossbar, each of said flanges having a latching element, one of said latching elements interengageable with the latching element of one of the pair of connectors and the other of said latching elements interengageable with the latching element of the other of the pair of connectors for locking the pair of connectors against said bracing member.

17. The mounting yoke of claim 16, wherein the latching element of each of the pair of connectors comprises a latching projection and said latching element of each of said pair of flanges comprises a resiliently yieldable detent latch.

18. The connector assembly of claim 16, wherein said bracing member conforms to the side surfaces adjacent to said bracing member.

19. The connector assembly of claim 16, wherein said mounting yoke enables the to be positioned within a parallel dress socket of the connector outlet.

* * * * *